United States Patent [19]

Eberhardt

[11] Patent Number: 4,762,281

[45] **Date of Patent: * Aug. 9, 1988**

[54] DRIVE ARRANGEMENTS FOR COMMINUTOR-PUMP ASSEMBLY

[75] Inventor: H. Alfred Eberhardt, Paoli, Pa.

[73] Assignee: Hale Fire Pump Company, Conshohocken, Pa.

[ * ] Notice: The portion of the term of this patent subsequent to Jan. 19, 2005 has been disclaimed.

[21] Appl. No.: 486,528

[22] Filed: Apr. 19, 1983

[51] Int. Cl.[4] ..... B02C 23/36

[52] U.S. Cl. ..... 241/46.06; 241/91; 241/101.2

[58] Field of Search ..... 241/79.3, 91, 222, 243, 241/300.1, 46.06, 46.15, 46.08, 93, 87, 101.2, 292.1, 293, 294, 32; 415/143

[56] References Cited

U.S. PATENT DOCUMENTS 3,382,902 5/1968 Blanshine et al. ..... 241/101.2 X
4,150,916 4/1979 Tsutsui et al. ..... 415/143
4,377,260 3/1983 Huffman ..... 241/101.2
4,378,093 3/1983 Keener ..... 241/46.06 X

FOREIGN PATENT DOCUMENTS 448642 5/1949 Italy ..... 241/293
706062 3/1954 United Kingdom ..... 241/46.06

*Primary Examiner*—P. W. Echols
*Assistant Examiner*—Joseph M. Gorski
*Attorney, Agent, or Firm*—Frank A. Follmer

[57] ABSTRACT

A comminutor and pump are assembled together with the pump being arranged to draw liquid, such as sewage, into a comminution chamber containing a rotating hollow cylinder which functions as a combination cutter and strainer. The solids in the sewage are comminuted until they are of a size small enough to pass through openings in the cylinder into the interior thereof from which the comminuted particles are pumped to a desired location, such as an irrigated field, by the pump. Various drive arrangements are provided to drive the pump at a relatively high speed and the rotating cylinder at a relatively low speed.

13 Claims, 6 Drawing Sheets

DRIVE ARRANGEMENTS FOR COMMINUTOR-PUMP ASSEMBLY

BACKGROUND AND SUMMARY OF THE INVENTION

This invention relates to a comminutor-pump assembly of a type suitable for use in a system for the application of livestock waste to land by irrigation. These systems are becoming increasingly popular because of the low cost and the ease of use thereof as compared with other systems. However, irrigation systems of this type require reliable means for reducing the size of the solids so as to avoid clogging of the centrifugal pump and the openings in the sprinkler heads or large guns used to spray the sewage and other solids out onto the field. It is also essential to maintain sufficient pumping pressure in the system.

A comminutor-pump assembly of the indicated type is shown in U.S. application Ser. No. 389,676 and has many features and advantages. For example, the comminutor-pump assembly of said application is constructed so that the comminutor and pump are driven by the same prime mover with the pump being arranged to draw the sewage into a comminution chamber containing a rotating hollow comminutor cylinder which functions as a combination cutter and strainer. The solids in the sewage are comminuted to a size small enough to pass through openings in the rotating cylinder into the interior thereof from which the comminuted particles are pumped to the irrigation spraying location by the pump. The pump shaft has a drive shaft extension which extends through the center of the rotating cylinder to drive a planetary gear system arranged so that the rotating cylinder is driven at a speed much less than the pump speed.

It is the general object of this invention to provide alternate drive arrangements for a comminutor-pump assembly of the indicated type, which drive arrangements are simple and inexpensive. Briefly stated, the general object of the invention is achieved by simplifying the gear requirements of the prior comminutor-pump assembly by eliminating the planetary gear system and substituting a simpler arrangement therefor.

One alternate drive arrangement comprises a gearbox constructed and arranged to be driven directly by a tractor power take-off and comprising a gear arrangement for stepping up the drive shaft for the pump and stepping down the drive shaft for the comminutor cylinder Another alternate arrangement involves the use of a piping bypass arrangement wherein the comminutor cylinder is driven directly from the tractor power take-off shaft and another shaft extending from the cylinder is arranged to drive the pump through a speed increaser gearbox. The piping arrangement involves the provision of a discharge pipe from a chamber in flow communication with the inside of the comminution cylinder and piped around to the inlet of the pump.

Another alternate arrangement is similar to that shown in said prior application except that it is provided with a hydraulic system consisting of a hydraulic pump that is driven by the pump impeller shaft and supplies hydraulic fluid to a hydraulic motor constructed and arranged to drive the comminutor cylinder at a reduced speed.

Another alternate involves the use of an electric motor which has one drive shaft connected to the impeller of the pump for driving the same and another drive shaft arranged through couplings or the like to drive a hydraulic pump. The hydraulic pump is arranged to drive a hydraulic motor which drives the comminutor cylinder at a reduced speed.

Another alternate involves the use of an electric motor arranged to drive the impeller shaft of the pump at a high speed and a second electric motor arranged to drive the comminutor cylinder at a low speed.

Another alternate involves the provision of a propeller on the impeller shaft for the pump at the inlet thereto to suppress the release of gas or cavitation bubbles at this low pressure region.

The details of the various alternate drive arrangements will be described more fully hereafter.

DETAILED DESCRIPTION OF THE PREFERRED EMBODIMENTS

Figure 1:
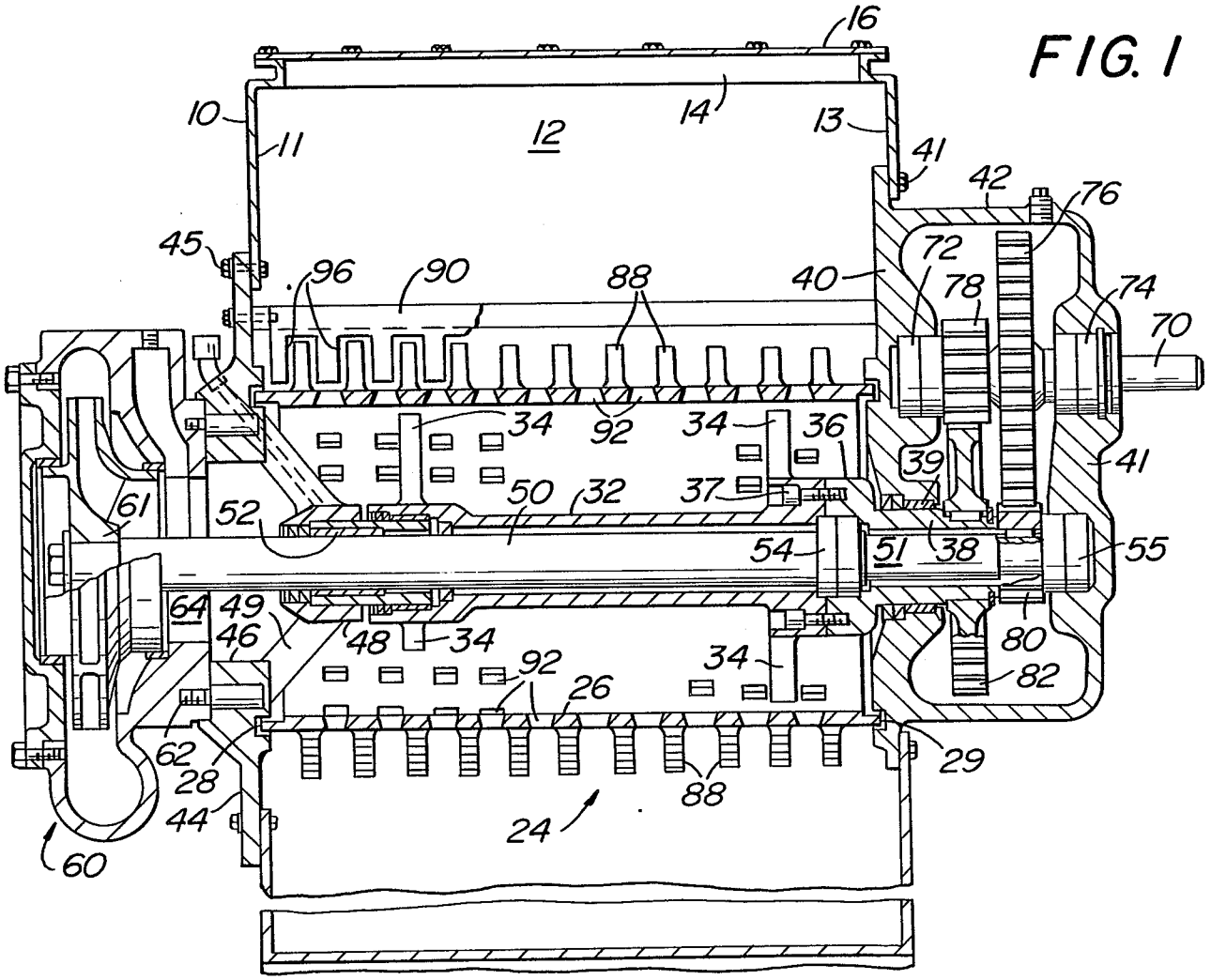
FIG. 1 is a sectional view of a first embodiment of a comminutor-pump assembly in accordance with the invention.

The comminutor-pump assembly of the invention shown in FIG. 1 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover and an inlet means in a side wall providing a passage through which the sewage enters comminution chamber 12.

The assembly comprises a comminutor drum 24 in the form of a hollow cylinder 26 which has an open end 28 and is closed at its opposite end 29. A tubular support 32 extends axially along the center of hollow cylinder 26. Two pairs of equally spaced spokes 34 extend radially between tubular support 32 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, one end of tubular support 32 is coupled to the enlarged end 36 of a hollow drive shaft 38 by means of bolts 37. Shaft 38 is rotatably supported by means of suitable bearings 39 in a side wall 40 of a gearbox 42 mounted on side wall 13 of housing 10 by bolts 41. Gearbox 42 contains gear system which drives comminutor drum 24 and the pump 60 in a manner to be described hereafter.

A pump inlet adapter 44 is mounted on side wall 11 by means of bolts 45. Adapter 44 has a central opening 46 and a centrally located hollow cylindrical hub 48 supported by three radially extending spokes 49. A drive shaft 50 extends through hub 48, tubular support 32 and hollow shaft 38 whereat a shaft portion 51 extends into gearbox 42. Drive shaft 50 is supported for rotation in suitable bearing means 52 in hub 48 and bearing means 54 in end 36 of hollow shaft 38. Shaft portion 51 is supported on bearing means 55 in a side wall 41 of gearbox 42.

By this arrangement, hollow cylinder 26 is mounted for rotation about its horizontal axis which is also aligned with the axis of shaft 50 and shaft 38. Open end 28 of hollow cylinder 26 is received within a circular groove in adapter 44 with a close fit so as to minimize leakage from comminution chamber 12 past this open end 28. In a like manner, closed end 29 of cylinder 26 cooperates with a circular groove in wall 40 with a close fit to minimize leakage therepast.

A centrifugal pump 60 is mounted on the outer side of adapter 44 by mounting bolts 62 with the pump suction inlet 64 in communication with the interior of hollow cylinder 26 through circular opening 46 of adapter 44 as shown in FIG. 1. The discharge of pump 60 is closed by a check valve means (not shown). The impeller 61 of pump 60 is secured in engagement with the end of shaft 50 to be driven thereby from shaft portion 51 in gearbox 42.

In accordance with the invention, drive means are provided causing rotation of pump 60 at a high speed and rotation of cylinder 26 at a relatively low speed to cause the solids and the liquids to be drawn into the comminution chamber 12 through its inlet, the comminution of the solids by the comminutor drum 24 and flow of comminuted solids into the interior of the cylinder 26 from which they flow to the suction of pump 60 and are discharged. In the embodiment of the invention shown in FIG. 1, this drive means includes the gearbox 42 which is provided with a two train gear system. The input shaft 70 of gearbox 42 is adapted to be driven by means such as the power take-off of a tractor or the like. Input shaft 70 is supported on bearings 72 and 74 in the side walls 40 and 41, respectively, of gearbox 42 and has keyed thereon a large gear 76 and a small gear 78. A high speed pinion gear 80 is keyed on pump drive shaft portion 51 and a low speed bull gear 82 is keyed on hollow drive shaft 38. Pinion gear 80 is mounted in driving engagement with large gear 76 on pump input shaft 70 and bull gear 82 is mounted in engagement with small gear 78 on pump input shaft 70.

By this arrangement, there is provided a first gear train including the small gear 78 on input shaft 70 and the large bull gear 82 on hollow drive shaft 38 and a second gear train including the large gear 76 on input shaft 70 and the small pinion gear 80 on pump drive shaft portion 51. The two gear trains in gearbox 42 thus function as a speed increaser to drive the pump 60 at a high speed and as a speed decreaser to drive the hollow cylinder 26 of comminutor drum 24 at a relatively low speed.

It is the rotation of hollow cylinder 26 that provides the movement for producing the comminution of the solids in comminution chamber 12. To this end, the hollow cylinder 26 is provided with a plurality of cutting teeth 88 which cooperate with three cutting blades 90 spaced circumferentially around the circumference of hollow cylinder 26 for achieving the comminution of solids within comminution chamber 12. The comminutor drum 24 is the same as that described in detail in said prior-mentioned application. Briefly, cutting teeth 88 are arranged in eleven circular rows extending circumferentially around the external wall of hollow cylinder 26 and are spaced apart along the circumferential rows with the teeth on each row being staggered in relation to the teeth in adjacent rows. Also, the teeth 88 in alternate circular rows are arranged in longitudinal rows set back progressively in the circumferential direction. This set back arrangement results in the progressive engagement of the teeth 88 with the cutting blades 90.

Hollow cylinder 26 is provided with a plurality of openings 92 equally distributed around the circumference thereof in locations between the circular rows of blades 90. Openings 92 provide passages to the interior of hollow cylinder 26 for the solids comminuted in chamber 12 and are tapered to get larger in the direction of flow so as to prevent the solids from sticking in the openings 92. Thus, when the solids are reduced to a size smaller than the openings 92 they can flow from comminution chamber 12 into the interior of the hollow cylinder 26. The size of the openings 92 determines the size of the largest particles that can flow from comminution chamber 12 into the interior of the hollow cylinder 26. The size of the openings 92 determines the size of the largest particles that can flow from comminution chamber 12 into the interior of hollow cylinder 26 for delivery to the irrigation location.

In the operation of the comminutor-pump assembly of the invention shown in FIG. 1 in a sewage irrigation system, the inlet means to comminution chamber 12 is connected to a supply of sewage by suitable conduit means and the discharge of pump 60 is connected to a suitable irrigation spray means, such as sprinkler heads or a large spray gun. By connecting the input shaft 70 of gearbox 42 to a drive means such as the power take-off of a tractor or the like, pump 60 is made operative by the rotation of the pump drive shaft 50 through gears 76 and 80 which cause rotation of drive shaft portion 51. The design is such that shaft 50 causes rotation of pump impeller 61 at a high speed. At the same time, gears 78 and 82 cause hollow drive shaft 38 to rotate at a relatively low speed to cause rotation of hollow cylinder 26 at a reduced speed. As hollow cylinder 26 rotates, cutting teeth 88 pass through cutouts 96 in blades 90 to comminute the solid particles in comminution chamber 12. When the particles in comminution chamber 12 are reduced to a suitable small size, they will pass through the openings 92 in hollow cylinder 26 into the interior thereof and be drawn to the suction of pump 60. Pump 60 will draw liquid from the interior of hollow cylinder 26 and pump it through its discharge, a check valve means, and a discharge conduit to the irrigation spray means.

Figure 2:
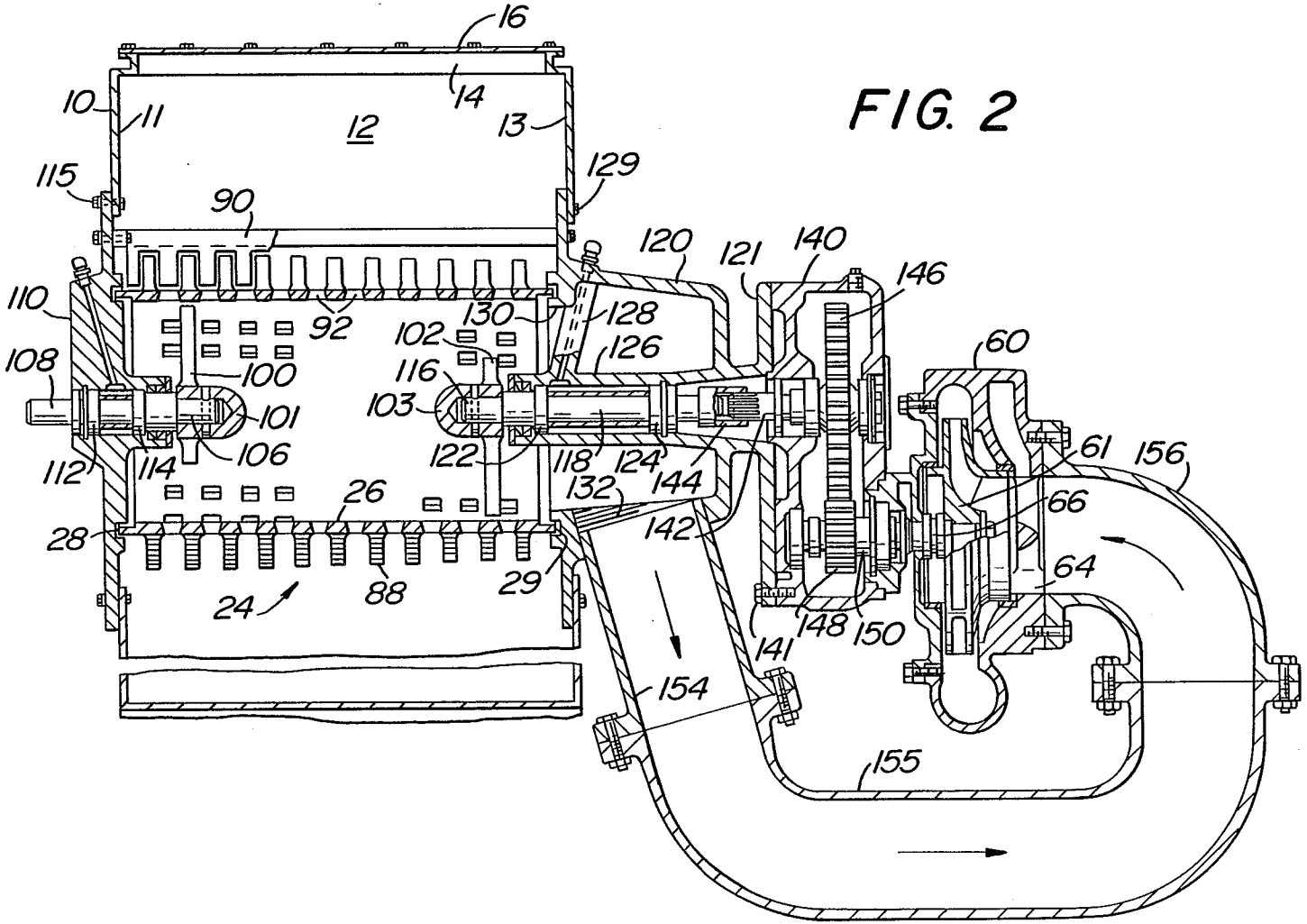
FIG. 2 is a sectional view of a second embodiment of a comminutor-pump assembly in accordance with the invention.

The comminutor-pump assembly shown in FIG. 2 involves the use of a piping bypass arrangement and the driving of the comminutor cylinder directly from the tractor power take-off shaft, there being provided another shaft extending from the cylinder arranged to drive the pump through a speed increaser gearbox. The embodiment shown in FIG. 2 comprises various parts which are the same as those used in the FIG. 1 embodiment wherefore the corresponding parts have been given like reference numerals as will be apparent in the description.

The comminutor-pump assembly of the invention shown in FIG. 2 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover, and an inlet means in a side wall providing a passage through which the sewage enters comminution chamber 12.

The assembly comprises a comminutor drum 24 in the form of a hollow cylinder 26 which is open at one end 29 and is closed at its opposite end 28 as will be described more fully hereafter. Two pairs of equally spaced spokes 100 and 102 extend radially between centrally located hub supports 101 and 103, respectively, and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, hub support 101 is mounted on and keyed to the end 106 of a drive shaft 108. Shaft 108 is rotatably supported in an end cover plate 110 by means of suitable bearings 112 and 114 contained therein. Plate 110 is mounted on side wall 11 of housing 10 by bolts 115. Also, hub support 103 is mounted on and keyed to the end 116 of a shaft 118 which is rotatably supported in a pump inlet adapter 120 by means of suitable bearings 122 and 124 contained in a centrally located hollow hub 126 supported on three spokes 128. A pump inlet adapter 120 is mounted on side wall 13 by means of bolts 129. Adapter 120 has a central opening 130 and a downwardly facing discharge port 132.

The arrangement is such that hollow cylinder 26 is mounted for rotation about its horizontal axis which is also aligned with the axes of shafts 108 and 118. The closed end 28 of hollow cylinder 26 is received within a circular groove in plate 110 with a close fit so as to minimize leakage from comminution chamber 12 therepast. Also, the open end 29 of cylinder 26 cooperates with a circular groove in adapter 120 with a close fit to minimize leakage therepast.

A unit comprising a step-up (speed increaser) gearbox 140 and a centrifugal pump 60 is mounted adjacent the outer end of shaft 118 at a mounting plate 121 formed on pump adapter 120 by means of bolts 141. The arrangement is such that the input shaft 142 of gearbox 140 is engaged with the outer end of shaft 118 by means of a spline-type of coupling 144. Gearbox 140 comprises a large gear 146 keyed on input shaft 142 and meshing with a small gear 148 keyed on the output shaft 150 to step-up the RPM to a suitable speed for driving the centrifugal pump 60. The pump drive shaft 66 is part of output shaft 150, the impeller 61 being keyed onto the pump shaft 66 as is conventional.

Centrifugal pump 60 is mounted with the pump suction inlet 64 in communication with the interior of hollow cylinder 26 through external piping means including a conduit 154 extending from discharge port 132, a conduit 156 leading to suction inlet 64 and a conduit 155 providing flow communication between conduits 154 and 156.

The discharge of pump 60 is closed by a check valve means (not shown).

As was discussed above in connection with the FIG. 1 embodiment, it is the rotation of hollow cylinder 26 that provides the movement for producing the comminution of the solids in comminution chamber 12. Thus, hollow cylinder 26 is provided with cutting teeth 88 which cooperate with three cutting blades 90 for achieving comminution of the solids within comminution chamber 12 as was discussed above. Also, hollow cylinder 26 is provided with a plurality of openings 92 distributed around the circumference to provide passages to the interior of hollow cylinder 26 for the solids comminuted in chamber 12.

In the operation of the comminutor-pump assembly of the invention shown in FIG. 2 in a sewage irrigation system, the inlet means to comminution chamber 12 is connected to a supply of sewage by suitable conduit means and the discharge of pump 60 is connected to a suitable irrigation spray means. In this embodiment of the invention, the comminutor cylinder 26 is driven directly from the power take-off shaft of the tractor which is connected to drive shaft 108 whereby cylinder 26 is driven at the tractor speed. The rotation of cylinder 26 is transmitted through shaft 118 to the input shaft 142 of the speed increaser 140 which steps up the RPM to its output shaft 150 which drives the pump 60 through shaft 66 at a high speed. As a hollow cylinder 26 rotates, cutting teeth 88 pass through cutouts 96 and blades 90 to comminute the solid particles in comminution chamber 12. When the particles in comminution chamber 12 are reduced to a suitable small size, they will pass through the openings 92 into the interior of hollow cylinder 26 and be drawn to the suction 64 of pump 60 by way of the external piping including conduits 154–156. The comminuted particles pass from the interior of hollow cylinder 26 into the internal chamber of pump adapter 120 and through discharge port 132 into the external piping. Pump 60 operates to draw liquid from the interior of hollow cylinder 26 and conduits 154–156 and pump it through its discharge, a check valve means and a discharge conduit to the irrigation spray means.

Figure 3:
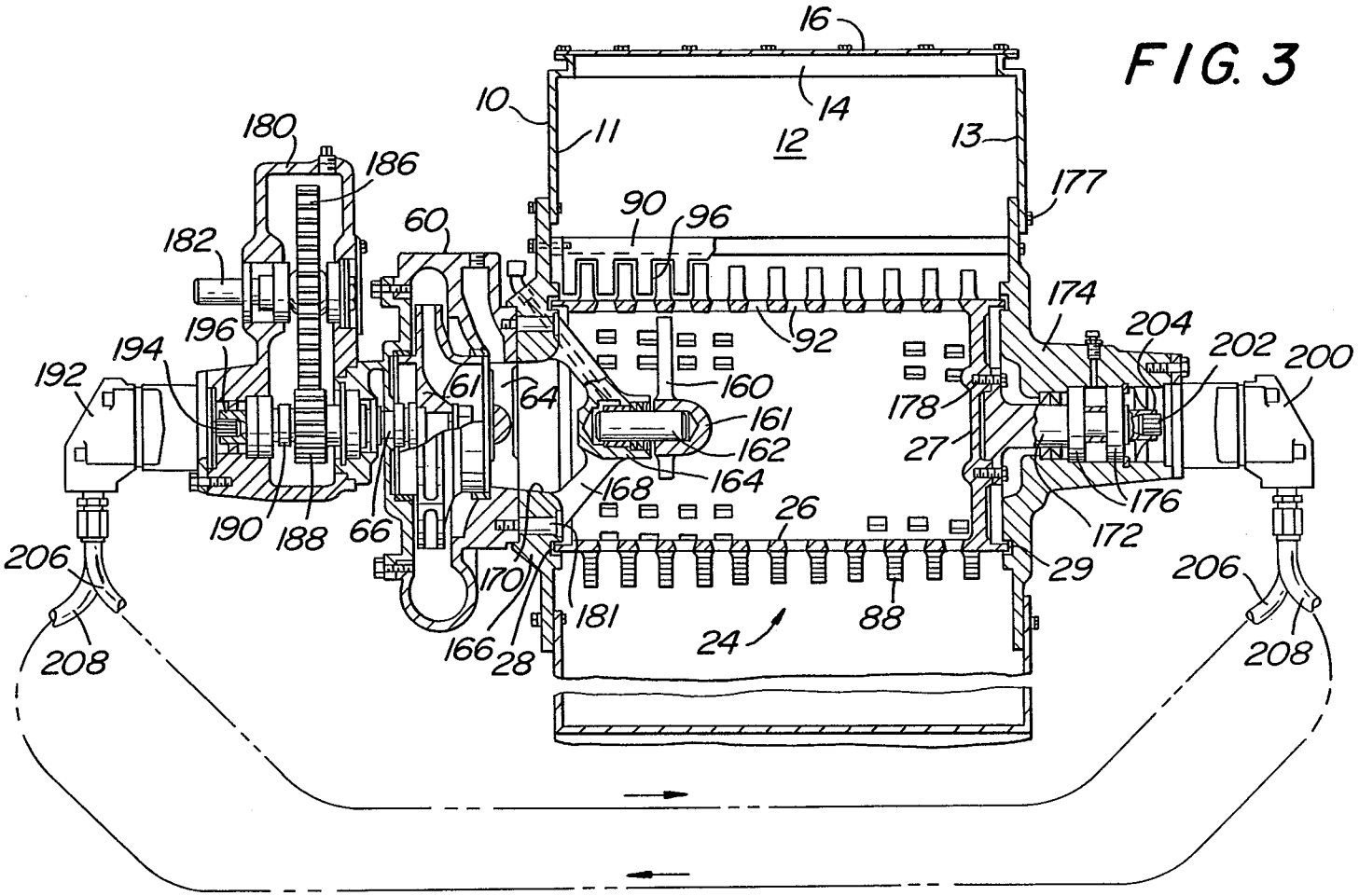
FIG. 3 is a sectional view of a third embodiment of a comminutor-pump assembly in accordance with the invention.

The comminutor-pump assembly shown in FIG. 3 involves the use of a hydraulic pump driven by the drive shaft of the pump impeller and arranged to supply hydraulic fluid to a hydraulic motor which drives the comminutor drum at a reduced speed. The embodiment shown in FIG. 3 comprises various parts which are the same as those used in the FIG. 1 embodiment wherefore the corresponding parts have been given like reference numerals as will be apparent in the description.

The comminutor-pump assembly of the invention shown in FIG. 3 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover, and an inlet means in a side wall providing a passage through which the sewage enters comminution chamber 12.

The assembly comprises a comminutor drum 24 in the form of a hollow cylinder 26 which is open at one end 28 and is closed at its opposite end 29 by an end plate 27. Near the open end of cylinder 26 there are three equally spaced spokes 160 that extend radially between a centrally located hub support 161 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, hub support 161 is rotatably mounted on a bearing shaft 162 which is supported in journal bearings contained in a centrally located cylindrical hub 164 of a pump inlet adapter 166. Adapter 166 is mounted on side wall 11 by bolts and has three radially extending spokes 168 for supporting hub 164 and a central opening 170 adjacent the open end of cylinder 26.

The closed end of cylinder 26 is rotatably mounted on a shaft 172 rotatably supported in an end support 174 by means of bearings 176. End support 174 is mounted on side wall 13 of housing 10 by bolts 177. Shaft 172 is mounted on the outer side of end plate 27 by bolts 178 which cooperate with an end flange on shaft 172 as shown in FIG. 3.

The arrangement is such that hollow cylinder 26 is mounted for rotation about its horizontal axis which is also aligned with the axes of shafts 162 and 172. The closed end 29 of hollow cylinder 26 is received within a circular groove in end support 174 with a close fit so as to minimize leakage from comminution chamber 12 therepast. Also, the open end 28 of cylinder 26 cooperates with a circular groove in adapter 166 with a close fit to minimize leakage therepast.

A unit comprising a step-up (speed increaser) gearbox 180 and a centrifugal pump 60 is mounted adjacent the outer end of pump inlet adapter 166 by means of bolts 181. Gearbox 180 comprises a large gear 186 keyed on an input shaft 182 and meshing with a small gear 188 keyed on the output shaft 190 to step-up the RPM to a suitable speed for driving the centrifugal pump 60. The pump drive shaft 66 is part of output shaft 190 so as to be driven thereby, the impeller 61 being keyed onto the pump shaft 66 as is conventional.

Centrifugal pump 60 is mounted with its pump suction inlet 64 in communication with the interior of hollow cylinder 26 through adapter opening 170. The discharge of pump 60 is closed by a check valve means (not shown).

In the embodiment of the invention shown in FIG. 3 there is provided a drive transmitting means for driving the cylinder 26 at a relatively low speed. This drive transmitting means includes a hydraulic pump 192 mounted on speed increaser gearbox 180 adjacent output shaft 190. The drive shaft 194 of hydraulic pump 192 is engaged with a portion of the output shaft 190 of the gearbox 180 by means of a coupling 196 therebetween. Coupling 196 preferably comprises a sline-type of coupling. A hydraulic motor 200 is mounted on the end of end support 174 and has an output drive shaft 202 engaged with drive shaft 172 by means of a spline-type of coupling 204. A hose means is provided for supplying hydraulic fluid from hydraulic pump 192 to hydraulic motor 200 for driving the same. The hose means comprises a supply line 206 for delivering hydraulic fluid from hydraulic pump 192 to hydraulic motor 200, and a return line 208 for delivering the fluid from hydraulic motor 200 to hydraulic pump 192 (see arrows in FIG. 3) as is conventional in the art. The hydraulic pump 192, which is designed to run at a relatively high speed, supplies hydraulic fluid to the hydraulic motor 200 through the hose means so that hydraulic motor 200 drives the cylinder 26 at a reduced speed. This speed reduction is achieved by the selection of the relative displacements of the hydraulic pump 192 and the hydraulic motor 200 as is conventional in the art. In other words, hydraulic motor 200 has a displacement that is much more per revolution than the displacement of hydraulic pump 192 so that the cylinder 26 is driven at a relatively low speed.

As was discussed above in connection with the FIG. 1 embodiment, it is the rotation of hollow cylinder 26 that provides the movement for producing the comminution of the solids in comminution chamber 12. Thus, hollow cylinder 26 is provided with cutting teeth 88 which cooperate with three cutting blades 90 for achieving comminution of the solids within comminution chamber 12 as was discussed above. Also, hollow cylinder 26 is provided with a plurality of openings 92 distributed around the circumference to provide passages to the interior of hollow cylinder 26 for the solids comminuted in chamber 12.

In the operation of the comminutor-pump assembly of the invention shown in FIG. 3 in a sewage irrigation system, the inlet means to comminution chamber 12 is connected to a supply of sewage by suitable conduit means and the discharge of pump 60 is connected to a suitable irrigation spray means. In this embodiment of the invention, by connecting the input shaft 182 of gearbox 180 a drive means such as the power take-off of a tractor or the like, pump 60 is made operative by the rotation of the pump drive shaft 66 through gears 186 and 188 and output shaft 190. As the output shaft 190 is rotated, it will cause rotation of drive shaft 194 to cause operation of hydraulic pump 192 coupled thereto, hydraulic pump 192, in turn, operates to supply fluid to hydraulic motor 200. The hydraulic motor 200 operates at a desired RPM to cause rotation of hollow cylinder 26 at a reduced speed. As hollow cylinder 26 rotates, cutting teeth 88 pass through cutouts 96 in blades 90 to comminute the solid particles in comminution chamber 12. When the particles in comminution chamber 12 are reduced to a suitable small size, they will pass through the openings 92 in hollow cylinder 26 into the interior thereof and be drawn to the suction of pump 60. Pump 60 will draw liquid from the interior of hollow cylinder 26 and pump it through its discharge, a check valve means, and a discharge conduit to the irrigation spray means.

Figure 4:
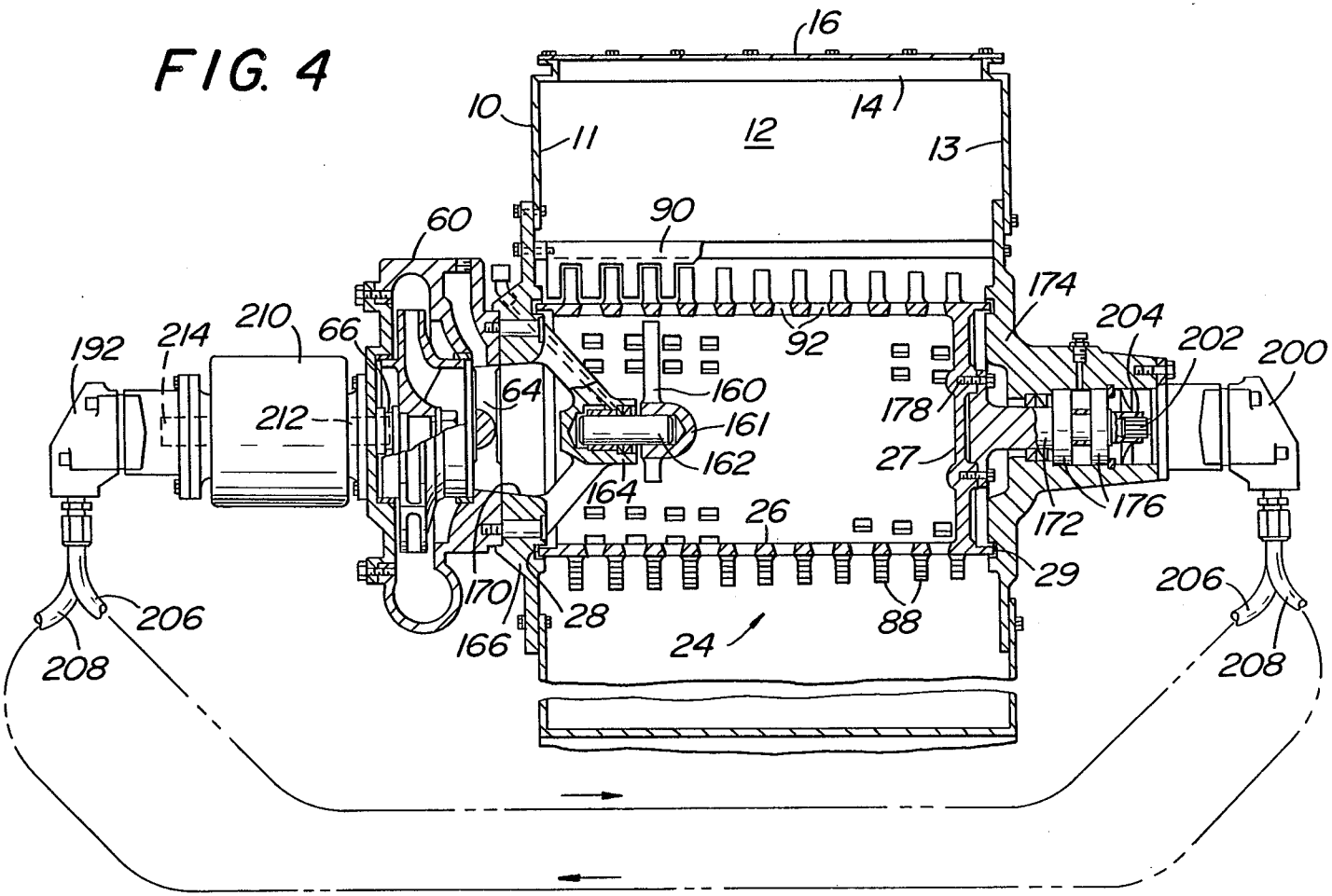
FIG. 4 is a sectional view of a fourth embodiment of a comminutor-pump assembly in accordance with the invention.

The comminutor-pump assembly shown in FIG. 4 involves the use of an electric motor which has one drive shaft connected to the impeller shaft for the centrifugal pump for driving the same at a high speed and another drive shaft arranged to drive a hydraulic pump through a coupling or the like. As in the case of the embodiment shown in FIG. 3, the hydraulic pump is arranged to drive a hydraulic motor which drives the comminutor cylinder at a reduced speed. The embodiment shown in FIG. 4 is very similar to the embodiment shown in FIG. 3 except that the drive for the centrifugal pump and for the hydraulic pump is an electric motor instead of a gearbox-type of drive. Accordingly, corresponding parts in the FIG. 4 embodiment have been given like reference numerals as those used in the description of the FIG. 3 embodiment as will be apparent from the following description.

The comminutor-pump assembly of the invention shown in FIG. 4 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover, and an inlet means in a side wall providing a passage through which the sewage enters comminution chamber 12.

The assembly comprises a comminutor drum 24 in the form of a hollow cylinder 26 which is open at one end 28 and is closed at its opposite end 29 by an end plate 27. Near the open end of cylinder 26 there are three equally spaced spokes 160 that extend radially between a centrally located hub support 161 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, hub support 161 is rotatably mounted on a bearing shaft 162 which is supported in journal bearings contained in a centrally located cylindrical hub 164 of a pump inlet adapter 166. Adapter 166 is mounted on side wall 11 by bolts and has a central opening 170 adjacent the open end 28 of cylinder 26.

The closed end of cylinder 26 is rotatably mounted on a shaft 172 rotatably supported in an end support 174 by means of bearings 176. End support 174 is mounted on side wall 13 of housing 10 by bolts. Shaft 172 is mounted on the outer side of end plate 27 by bolts 178 which cooperate with an end flange on shaft 172.

The arrangement is such that hollow cylinder 26 is mounted for rotation about its horizontal axis which is also aligned with the axes of shafts 162 and 172.

A unit comprising an electric motor 210 and a centrifugal pump 60 is mounted adjacent the outer end of pump inlet adapter 166 by means of bolts.

The drive means for causing rotation of centrifugal pump 60 and comminutor cylinder 26 comprises electric motor 210 which is double-ended. Motor 210 has a power output shaft 212 connected to the pump drive shaft 66 for causing rotation thereof at a relatively high speed sufficient for the operation of the centrifugal pump, such as for example, 1800 RPM. Motor 210 comprises a second power output shaft 214 engaged by a coupling to the drive shaft of the hydraulic pump 192 which is mounted at the other end of motor 210 as viewed in FIG. 4.

Centrifugal pump 60 is mounted with its pump suction inlet 64 in comminucation with the interior of hollow cylinder 26 through adapter opening 170. The discharge of pump 60 is closed by a check valve means (not shown).

. In the embodiment of the invention shown in FIG. 4 there is provided a drive transmitting means for driving the cylinder 26 at a relatively low speed. This drive transmitting means includes hydraulic pump 192 which is mounted adjacent output shaft 214 of motor 210. A hydraulic motor 200 is mounted on the end of end support 174 and has an output drive shaft 202 engaged with drive shaft 172 by means of a spline-type of coupling 204. A hose means is provided for supplying hydraulic fluid from hydraulic pump 192 to the hydraulic motor 200 for driving the same. The hose means comprises a supply line 206 for delivering hydraulic fluid from hydraulic pump 192 to hydraulic motor 200, and a return line 208 for delivering the fluid from hydraulic motor 200 to hydraulic pump 192 as is conventional in the art. The hydraulic pump 192, which is running at a relatively high speed, supplies hydraulic fluid to the hydraulic motor 200 through the hose means so that the hydraulic motor 200 drives the cylinder 26 at a reduced speed. This speed reduction is achieved by the selection of the relative displacements of the hydraulic pump 192 and the hydraulic motor 200 as is conventional in the art.

As was discussed above in connection with the FIG. 1 embodiment, it is the rotation of hollow cylinder 26 that provides the movement for producing the comminution of the solids in comminution chamber 12. Thus, hollow cylinder 26 is provided with cutting teeth 88 which cooperate with three cutting blades 90 for achieving comminution of the solids within comminution chamber 12 as was discussed above. Also, hollow cylinder 26 is provided with a plurality of openings 92 distributed around the circumference to provide passages to the interior of hollow cylinder 26 for the solids comminuted in chamber 12.

The operation of the comminutor-pump assembly of the invention shown in FIG. 4 in a sewage irrigation system is the same as the FIG. 3 embodiment except that electric motor 210 functions as the drive means for hydraulic pump 192 and centrifugal pump 60.

Figure 5:
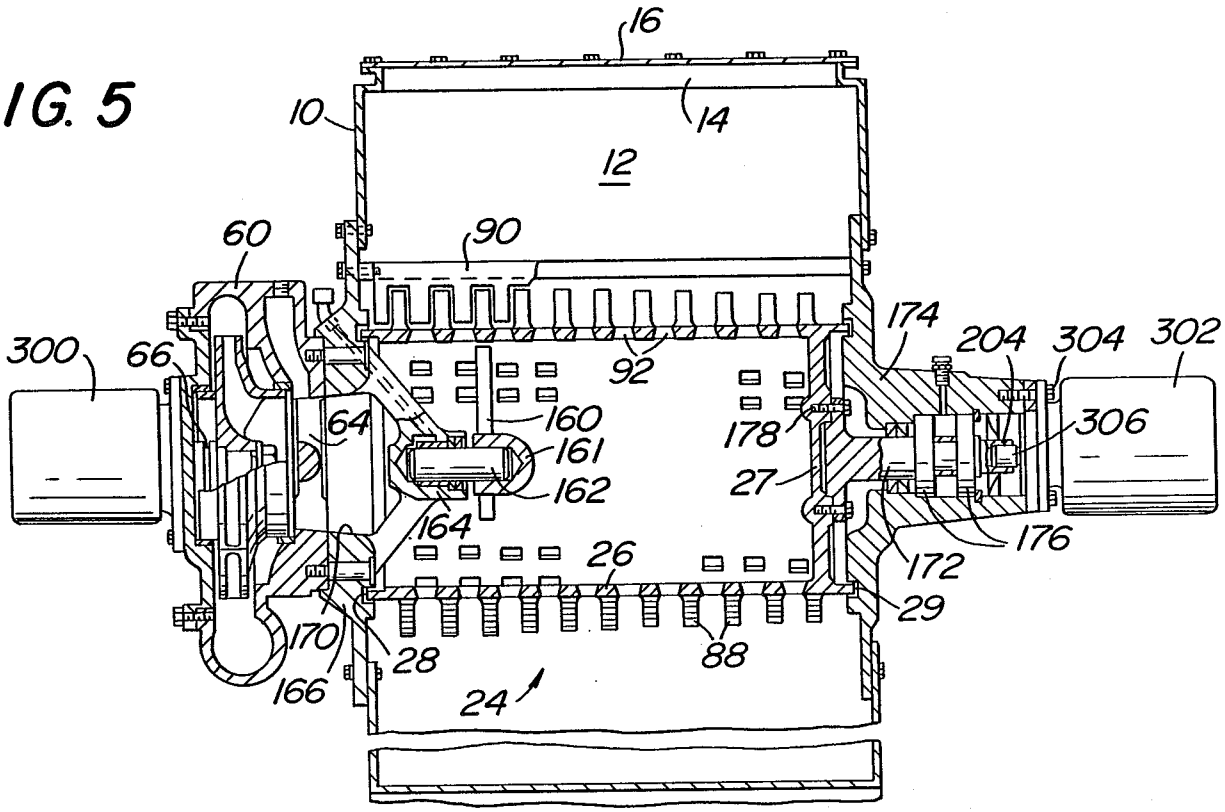
FIG. 5 is a sectional view of a fifth embodiment of a comminutor-pump assembly in accordance with the invention.

The comminutor-pump assembly shown in FIG. 5 involves the use of an electric motor which has its shaft connected to the impeller shaft for the centrifugal pump for driving the same at a high speed and another electric motor has its drive shaft arranged to drive the comminutor cylinder at a reduced speed. The embodiment shown in FIG. 5 is very similar to the embodiment shown in FIGS. 3 and 4 except that a first electric motor drives the centrifugal pump and a second electric motor drives the comminutor cylinder at a low speed. Accordingly, corresponding parts in the FIG. 5 embodiment have been given like reference numerals as those used in the description of the FIGS. 3 and 4 embodiments as will be apparent from the following description.

The comminutor-pump assembly of the invention shown in FIG. 5 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover, and an inlet means in a side wall providing a passage through which the sewage enters comminution chamber 12.

The assembly comprises a comminutor drum 24 in the form of a hollow cylinder 26 which is open at one end 28 and is closed at its opposite end 29 by an end plate 27. Near the open end of cylinder 26 there are three equally spaced spokes 160 that extend radially between a centrally located hub support 161 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, hub support 161 is rotatably mounted on a bearing shaft 162 which is supported in journal bearings contained in a centrally located cylindrical hub 164 of a pump inlet adapter 166. Adapter 166 is mounted on side wall 11 by bolts and has a central opening 170 adjacent the open end 28 of cylinder 26.

The closed end of cylinder 26 is rotatably mounted on a shaft 172 rotatably supported in an end support 174 by means of bearings 176. End support 174 is mounted on side wall 13 of housing 10 by bolts. Shaft 172 is mounted on the outer side of end plate 27 by bolts 178 which cooperate with an end flange on shaft 172.

The arrangement is such that hollow cylinder 26 is mounted for rotation about its horizontal axis which is also aligned with the axes of shafts 162 and 172.

A unit comprising an electric motor 300 and a centrifugal pump 60 is mounted adjacent the outer end of pump inlet adapter 166 by means of bolts. The power output shaft of motor 300 is connected to the pump drive shaft 66 for causing rotation thereof at a relatively high speed.

Centrifugal pump 60 is mounted with its pump suction inlet 64 in communication with the interior of hollow cylinder 26 through adapter opening 170. The discharge of pump 60 is closed by a check valve means (not shown).

In the embodiment of the invention shown in FIG. 5 there is provided a drive transmitting means for driving the cylinder 26 at a relatively low speed. This drive transmitting means includes an electric motor 302 mounted on end support 174 by means of bolts 304. Motor 302 has its power output shaft 306 engaged with drive shaft 172 by means of coupling 204 for driving cylinder 26 at a relatively low speed suitable for its comminution function.

As was discussed above in connection with the FIG. 1 embodiment, it is the rotation of hollow cylinder 26 that provides the movement for producing the comminution of the solids in comminution chamber 12. Thus, hollow cylinder 26 is provided with cutting teeth 88 which cooperate with three cutting blades 90 for achieving comminution of the solids within comminution chamber 12 as was discussed above. Also, hollow cylinder 26 is provided with a plurality of openings 92 distributed around the circumference to provide passages to the interior of hollow cylinder 26 for the solids comminuted in chamber 12.

The operation of the comminutor-pump assembly of the invention shown in FIG. 5 in a sewage irrigation system is the same as the FIG. 3 embodiment except that electric motor 300 functions as the drive means for centrifugal pump 60 and electric motor 302 functions as the drive for cylinder 26.

Figure 6:
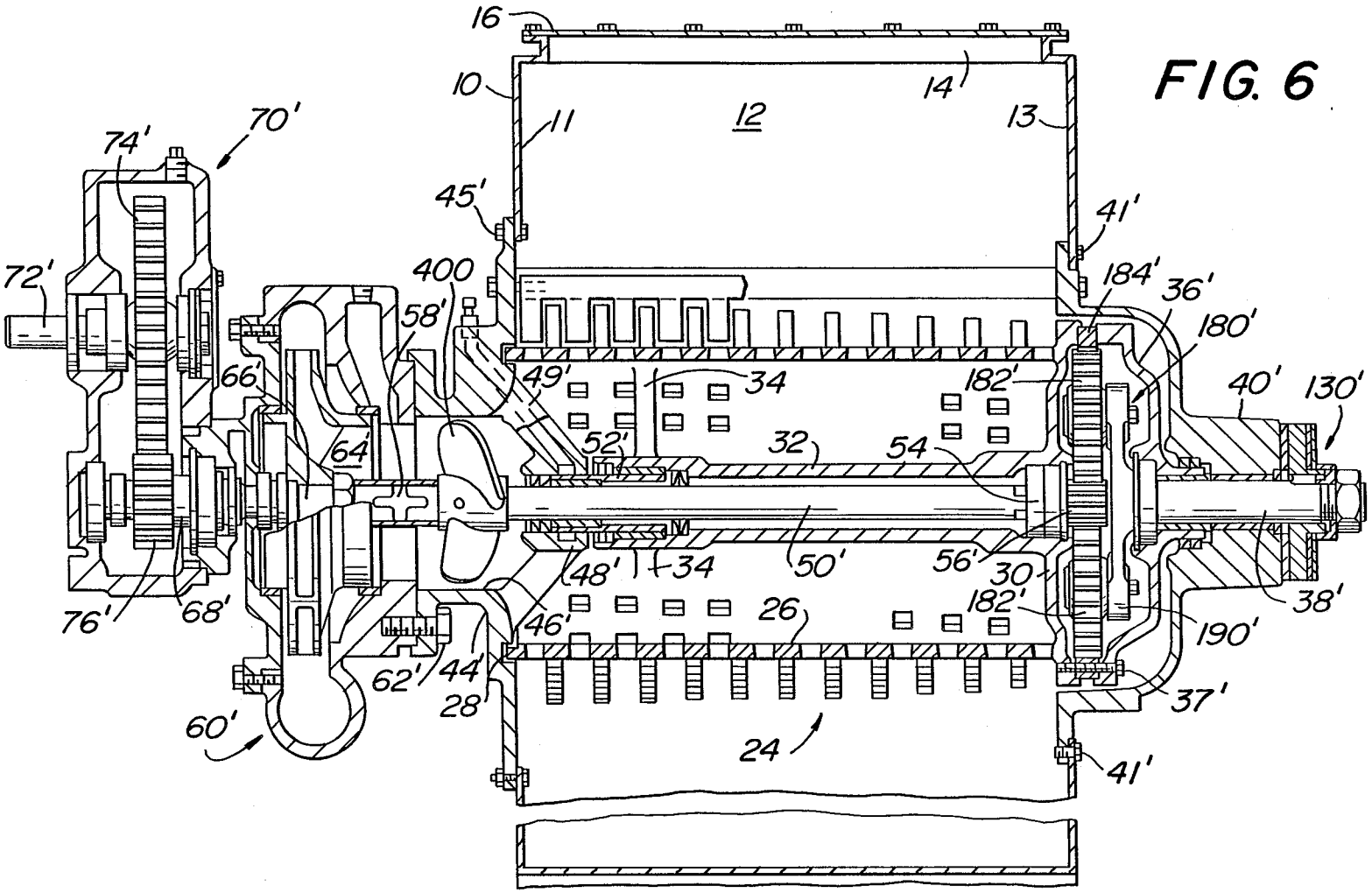
FIG. 6 is a sectional view of a sixth embodiment of a comminutor-pump assembly in accordance with the invention.

The comminutor-pump assembly of the invention shown in FIG. 6 comprises a main housing 10 having a box-like shape and defining a comminution chamber 12 therein. Housing 10 has a top access opening 14 provided with a cover 16. As is shown in U.S. application Ser. No. 389,676, housing 10 is supported on a transportable cart means and is provided with a side access opening provided with a cover and an inlet means in a side wall providing a passage through which the sewage enters comminution chamber 12.

The assembly comprises a comminutor drum 24 in the form of a hollow cylinder 26 which has an open end 28 and is closed at its opposite end by an end wall 30. A tubular support 32 extends from end wall 30 axially along the center of hollow cylinder 26. Four spaced apart spokes 34 extend radially between tubular support 32 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, the closed end of hollow cylinder 26 has a drum cover 36' mounted thereon by means of bolts 37'. Drum cover 36' is rotatively supported on a shaft 38' by means of suitable bearings. Shaft 38' is mounted on an end support 40' secured to side wall 13 by bolts 41'. Drum cover 36' cooperates with end wall 30 to define a chamber containing a planetary gear system which drives comminutor drum 24 in a manner to be described hereafter.

A pump inlet adapter 44' is mounted on side wall 11 by means of bolts 45'. Adapter 44' has a central opening 46' and a centrally located hollow cylindrical hub 48' supported by three radially extending spokes 49'. A drive shaft extension 50' extends through hub 48', through tubular support 32, and through an opening in end wall 30 into the gear containing chamber defined by drum cover 36' on the outside of end wall 30. Shaft extension 50' is supported for rotation in suitable bearing means 52' in hub 48' and bearing means 54' in end wall 30.

At its one end, shaft extension 50' has engaged thereon a drive gear 56' for the planetary gear system located within the chamber defined by drum cover 36' and, at its other end, shaft extension 50 is engaged in a coupling 58'.

By this arrangement, hollow cylinder 26 is mounted for rotation about its horizontal axis which is also aligned with the axis of shaft extension 50' and shaft 38'. Open end 28 of hollow cylinder 26 is received within a circular groove in adapter 44' with a close fit so as to minimize leakage from comminution chamber 12 past this open end 28.

As will be described hereafter, shaft 38' is engaged with the planetary gear system and is normally held against rotation. However, when cylinder 26 is jammed against rotation, shaft 38' functions as an output shaft for the planetary gear system and rotates.

A centrifugal pump 60' is mounted on the outer side of adapter 44' by mounting bolts 62' with the pump suction inlet 64' in communication with the interior of hollow cylinder 26 through circular opening 46' of adpater 44' as shown in FIG. 6. The discharge of pump 60' is closed by a check valve means (not shown). The drive shaft 66' of pump 60' has its extended end engaged within coupling 58' and its other end in engagement with the output shaft 68' of a step-up gearbox 70'. The input shaft 72' of gearbox 70' is adpated to be driven by means such as the power take-off of a tractor or the like. Gearbox 70' comprises a large gear 74' and a small gear 76' constructed and arranged to step-up the RPM to a suitable speed for driving the centrifugal pump 60'. It is to be noted that as pump shaft 66' is driven from the output shaft 68' of gearbox 70', the shaft extension 50' will be rotated at the same speed through the coupling 58'.

A planetary gear system 180' is contained within the chamber defined by drum cover 36' and is responsive to the rotation of shaft extension 50' to cause hollow cylinder 26 to rotate at a reduced speed. To this end, planetary gear system 180' is identical to that shown in FIGS. 9–11 of U.S. application Ser. No. 398,676 and comprises a central pinion gear 56' engaged on the end of shaft extension 50' and three large planet gears 182' engaged with gear 56' at equally spaced circumferencial locations thereof. Gears 182' are rotatably mounted on stationary pins which are fixedly mounted on a spider portion 190' formed on the end of the normally stationary output shaft 38' of planetary gear system 180'. Planet gears 182' are supported so as to engage the internal teeth of a ring gear 184' which is mounted for rotation with rotating cylinder 26' and drum cover 36'. Ring gear 184' is secured between the closed end of cylinder 26 and the inner end of drum cover 36' by mounting bolts 37'.

In operation, planetary gear system 180', in response to rotation of sun gear 56' by shaft extension 50', causes planet gears 182' to rotate on their pins whereby ring gear 184 is caused to revolve around central gear 56'. This movement of ring gear 184' causes a corresponding movement of rotating cylinder 26 and drum cover 36'.

As described above, it is the rotation of hollow cylinder 26 that provides the movement for producing the comminution of the solids in the sewage. In the event that the rotating cylinder 26 becomes jammed, the rotating central pinion gear 56' will cause the planetary gear system 180' to drive the normally stationary output shaft 38' to cause rotation thereof. As described in U.S. application Ser. No. 398,676, a clutch means 130' operates to permit this rotation of output shaft 38'. It will be apparent that in the jammed position of the device, the ring gear 184' remains stationary while the planet gears 182' and their pins are caused to revolve around the axis of gear 56' thereby causing rotation of output shaft 38'.

In the embodiment of the invention shown in FIG. 6 there is provided means for increasing the volume of the comminuted sewage flow from the interior of cylinder 26 and through pump 60'. To this end, a two-bladed propeller 400 is mounted in a fixed position on shaft extension 50' in the region of the inlet (suction) to the impeller of pump 60'. Propeller 400 is constructed to act as a pump to impart energy to the fluid entering the pump impeller region. To this end, the variable angle of the blades is designed to impell the sewage with minimum shock toward the inlet of the centrifugal impeller of pump 60'. Because of the resultant increase in pressure and axial velocity, the propeller 400 functions to suppress the release of gas or cavitation bubbles at this location at the pump inlet (suction) which will enable the impeller to operate at higher flow capacities. It is at this region at the entrance to the impeller that a minimum absolute pressure exists whereby gas bubbles tend to expand readily to displace possible liquid entering the pump to thereby reduce the pump capacity. This condition is obviated by the provision of propeller 400 as described above.

What is claimed is:

1. A comminutor-pump assembly comprising:

a housing defining a comminution chamber and having an inlet for a solids containing liquid, a comminutor drum including a hollow cylinder having a cylindrical wall defining exterior and interior surfaces, an interior chamber enclosed by said interior surface of said cylindrical wall, means mounting said cylinder to extend within said comminution chamber and for rotation about its longitudinal axis, a drive shaft for causing rotation of said cylinder, one end of said cylinder being open, means closing the end of said cylinder opposite said one end, a plurality of cutting teeth on the exterior surface of said cylindrical wall, blade means extending within said comminution chamber on the exterior of said cylinder for cooperating with said cutting teeth so as to comminute solids within said chamber, a plurality of openings in said cylindrical wall of said cylinder through which comminuted solids of a predetermined size may pass into said interior chamber of said cylinder, a pump mounted on said housing and having a drive shaft, said pump having a suction through which liquid is drawn into the pump, means connecting the suction of said pump in flow communication with said interior chamber of said cylinder, and drive means for causing rotation of said pump and rotation of said cylinder to cause said solids and the liquid to be drawn into the comminution chamber through said inlet, the comminution of the solids by said teeth, and the passage of comminuted solids through said openings into said interior chamber of said cylinder from which they flow to the suction of the pump and are discharged therefrom, said drive means having an input drive shaft, first drive transmitting means connected between said input drive shaft and said cylinder drive shaft for causing rotation of the cylinder at a relatively low speed, and second drive transmitting means connected between said input drive shaft and said pump drive shaft for causing rotation thereof at a relatively high speed.

2. A comminutor-pump assembly according to claim 1 wherein said first drive transmitting means comprises a gear train including a small gear mounted on said input drive shaft and a large gear intermeshing with said small gear and mounted on said cylinder drive shaft, and said second drive transmitting means comprises a large gear mounted on said input drive shaft and a small gear mounted on said pump drive shaft, all of said gears being mounted in a gearbox mounted on said housing.

3. A comminutor-pump assembly according to claim 2 wherein said gearbox is mounted on said housing adjacent to the closed end of said cylinder and said pump is mounted on said housing adjacent to the open end of said cylinder.

4. A comminutor-pump assembly according to claim 3 wherein said cylinder drive shaft is a hollow shaft, said pump drive shaft being arranged to extend within the interior of said hollow cylinder drive shaft.

5. A comminutor-pump assembly according to claim 1 wherein said first drive transmitting means includes a direct drive connection between said input drive shaft and said cylinder for rotating said cylinder at the same speed as said input drive shaft rotates, said second drive transmitting means including an output drive shaft extending from said cylinder to the exterior of said housing, and including a speed increaser in driving engagement between said output drive shaft and said drive shaft of said pump.

6. A comminutor-pump assembly according to claim 5 wherein said speed increaser is mounted on said housing adjacent said output drive shaft, and said pump is mounted adjacent said speed increaser, and including external piping means for delivering the comminuted solids from the interior of said cylinder to the suction of said pump.

7. A comminutor-pump according to claim 1 wherein said pump is mounted on said housing adjacent the open end of said cylinder with its suction in flow communication with the interior thereof, said second drive transmitting means including a speed increaser having its input shaft connected to the input drive shaft and a first portion of its output shaft engaged with said pump drive shaft, said first drive transmitting means including a hydraulic pump mounted adjacent said speed increaser and having a drive shaft, a second portion of said output shaft of said speed increaser being engaged with the drive shaft of said hydraulic pump for driving the same, a hydraulic motor mounted on said housing adjacent the closed end of said cylinder and having a drive connection with said cylinder drive shaft, and hose means for supplying hydraulic fluid from said hydraulic pump to said hydraulic motor for driving the same, said hydraulic motor having a displacement such that said cylinder is driven at a relatively low speed.

8. a comminutor-pump assembly according to claim 7 wherein said drive connection between said hydraulic motor and said cylinder comprises a spline-type of coupling, and said drive connection between said speed increaser output shaft and said hydraulic pump comprises a spine-type of coupling.

9. A comminutor-pump assembly comprising:

a housing defining a comminution chamber and having an inlet for a solids containing liquid, a comminutor drum means including at least one hollow cylinder having a cylindrical wall defining exterior and interior surfaces, an interior chamber enclosed by said interior surface of said cylindrical wall, means mounting said cylinder to extend within said comminution chamber and for rotation about its longitudinal axis, a drive shaft for causing rotation of said cylinder, a plurality of cutting teeth on the exterior surface of said cylindrical wall, means extending within said comminution chamber on the exterior of said cylinder for cooperating with said cutting teeth so as to comminute solids within said chamber, a plurality of openings in said cylindrical wall of said cylinder through which comminuted solids of a predetermined size may pass into said interior chamber of said cylinder, a pump mounted on said housing and having a drive shaft, said pump having a suction through which liquid is drawn into the pump, flow passage means connecting the suction of said pump in flow communication with the comminuted solids, and drive means for causing rotation of said pump and rotation of said cylinder to cause said solids and the liquid to be drawn into the comminution chamber through said inlet, the comminution of the solids by said teeth, and the flow of comminuted solids through the cylinder from which they flow to the suction of the pump and are discharged therefrom, said drive means having an input drive shaft, first drive transmitting means connected between said input drive shaft and said cylinder drive shaft for causing rotation of the cylinder at a relatively low speed, and second drive transmitting means connected between said input drive shaft and said pump drive shaft for causing rotation thereof at a relatively high speed.

10. A comminutor-pump assembly according to claim 9 wherein said first drive transmitting means comprises a gear train including a small gear mounted on said input drive shaft and a large gear intermeshing with said small gear and mounted on said cylinder drive shaft, and said second drive transmitting means comprises a large gear mounted on said input drive shaft and a small gear mounted on said pump drive shaft, all of said gears being mounted in a gearbox mounted on said housing.

11. A comminutor-pump assembly according to claim 10 wherein said gearbox is mounted on said housing adjacent to the closed end of said cylinder and said pump is mounted on said housing adjacent to the open end of said cylinder.

12. A comminutor-pump assembly according to claim 9 wherein a propeller means is mounted to rotate with said pump drive shaft and being located adjacent said pump suction, said propeller means being constructed and arranged to drive the comminuted solids into said pump suction whereby the release of gas or cavitation bubbles is suppressed.

13. A comminutor-pump according to claim 9 including a propeller means mounted to rotate with said pump drive shaft at a location adjacent said pump suction, said propeller means including a plurality of independent blades constructed and arranged to drive the comminuted solids into said pump suction, said flow passage means being constructed and arranged to provide a substantially barrier free flow passage between said interior chamber of said cylinder and said pump suction for the unobstructed flow of comminuted solids to the suction of the pump.

* * * * *